United States Patent [19]

Burroughs

[11] 4,149,571

[45] Apr. 17, 1979

[54] PAPERMAKING FABRICS

[75] Inventor: Ralph H. Burroughs, Delmar, N.Y.

[73] Assignee: Huyck Corporation, Wake Forrest, N.C.

[21] Appl. No.: 883,072

[22] Filed: Mar. 3, 1978

[51] Int. Cl.[2] ..... D21F 1/10

[52] U.S. Cl. ..... 139/383 A; 162/348; 139/420 R; 139/425 A

[58] Field of Search ..... 139/383 R, 383 A, 420 R, 139/425 R, 425 A, 426; 162/348, DIG. 1

[56] References Cited

U.S. PATENT DOCUMENTS

| | | | |
|---|---|---|---|
| 2,554,034 | 5/1951 | Koester et al. | 139/383 A |
| 3,216,893 | 11/1965 | Schuster | 139/425 A |
| 3,745,066 | 7/1973 | Bleuer | 139/420 R |
| 3,915,202 | 10/1975 | Curtis et al. | 139/425 A |

*Primary Examiner*—Henry Jaudon

*Attorney, Agent, or Firm*—Melville, Strasser, Foster & Hoffman

[57] ABSTRACT

Improved paper forming and tissue transfer fabrics having enhanced stability and stretch resistance as well as improved bicrimp configuration, the fabrics being characterized by the alternate use of very high modulus and very low modulus yarns in the machine direction of the fabrics, the alternate very high and very low modulus yarns being woven using either pick and pick or two picks in a shed weaving techniques, the very high modulus yarns having an initial (1%) modulus greater than 2.0 gpd and the very low modulus yarns having an initial (1%) modulus of 0.2 to 0.8 gpd.

7 Claims, 4 Drawing Figures

PAPERMAKING FABRICS

The present invention relates to papermaking fabrics, and has to do more particularly with the provision of improved fabrics which are particularly suited for use as forming fabrics and as tissue transfer fabrics.

BACKGROUND OF THE INVENTION

While numerous types of forming fabrics have hitherto been proposed, the conventional techniques for weaving such fabrics, whether woven flat or endless, have presented a number of problems. For example, efforts to enhance stretch resistance through the use of high modulus yarns in the machine direction, i.e., the yarns extending lengthwise of the fabric when in use, can result in reduced fabric stability due to the fact that the crimp may be pulled out of the machine direction yarns during the manufacture of the fabric in order to obtain the desired stretch resistance. The lack of good crimp in the machine direction yarns, as well as in the cross-machine direction yarns, i.e., the yarns extending laterally of the fabric when in use, results in shoviness and poor fabric stability. Important also to the papermaker is effective sheet support and the reduction in wire marking, and efforts are constantly being made to improve the paper forming characteristics of the fabrics.

In the case of tissue transfer fabrics currently in use, they suffer from loss of strength through heat degradation during use on the papermaking machine, and they also suffer from lack of stability due to loss of crimp. Additionally, an embossed pattern is required for a tissue sheet, and various expedients have hitherto been proposed to impart the desired embossed effect to a tissue fabric.

Some of the expedients hitherto proposed to improve the various characteristics of forming fabrics and tissue transfer fabrics have included the use of warp yarns laid in pairs, the use of various combinations of metallic strands and non-metallic yarns, and the use of polyester yarns in which the machine direction yarns have a higher modulus of elasticity than do the cross-machine direction yarns.

In contrast to the foregoing, the present invention seeks to overcome the difficulties encountered in prior art fabrics and also provide improved sheet forming characteristics by the use of both very high and very low modulus yarns in the machine direction of the fabric, the resultant fabrics being characterized by enhanced initial stretch resistance, as well as enhanced bicrimp configuration. In the case of tissue transfer fabrics, the very high modulus yarns additionally provide enhanced heat resistance characteristics. The term bicrimp configuration as used herein refers to the fact that both the machine direction yarns and the cross-machine direction yarns define knuckles having significant crimp amplitudes, the knuckles contributing to fabric stability as well as to the quality of the paper or tissue being produced.

SUMMARY OF THE INVENTION

In accordance with the present invention, the fabrics are woven utilizing combinations of very high and very low modulus yarns extending in the machine direction of the fabric. The modulus of the yarn is the ratio of stress to strain. High modulus yarns are relatively stiff and exhibit low elongation under load. Low modulus yarns, on the other hand, are extensible and exhibit high elongation under load. In the textile industry, modulus is expressed in grams per denier (gpd) where denier is the weight in grams of 9000 meters of yarn. Conventionally the modulus is reported at 1% elongation, which is referred to in the industry as the initial modulus.

In accordance with the invention, the very high modulus yarns, which are utilized in the machine direction to provide strength, as well as high heat resistance in the case of tissue transfer fabrics, have an initial (1%) modulus which is greater than 2 gpd. The very low modulus yarns, on the other hand, are more easily deformed or crimped during the weaving process and are chosen to have an initial modulus of from 0.2 to 0.8 gpd. While the crimped very low modulus yarns do not in themselves possess good crimp stability and would pull out easily under excessive strain, the combined machine direction and cross-machine direction bicrimp obtained in accordance with the invention effectively interlocks the yarns so as to provide the desired fabric stability. The very low modulus yarns are preferably of larger diameter than the very high modulus yarns, the larger diameter very low modulus yarns effectively permitting the very high modulus yarns to be buried within the body of the fabric, although the important parameter is that the knuckles or fabric surfaces formed by the crimped yarns lie above (or below) the surfaces of the very high modulus yarns, and it is not always necessary for the very low modulus yarns to be of larger diameter to achieve the desired result.

The weaving techniques employed may be varied consistent with the desired placement of the very high and very low modulus yarns relative to each other. While a 1:1 ratio of very high to very low modulus yarns is preferred, other ratios may be utilized to obtain the desired effect. Where greatly enhanced strength and stretch resistance are desired, the number of very high modulus yarns may be increased; and similarly, where greater bicrimp or a more closed fabric is desired, the number of very low modulus yarns may be increased relative to the number of very high modulus yarns. It also will be understood that various weave patterns may be employed depending upon the desired surface characteristics, and the weave may be a plain weave, a twill weave, a satin weave, or such other weave pattern as will produce the desired characteristics in the fabric.

The fabrics may be woven endless or flat depending upon available equipment. Where the fabric is woven endless either a pick and pick or two picks in a shed techniques may be utilized. In pick and pick weaving, one pick is thrown, the shed changed, and another pick thrown from a different shuttle, the yarn in one shuttle being very high modulus yarn and the yarn in the other shuttle being very low modulus yarn, thereby providing alternate very high and very low modulus yarns. In two picks in a shed weaving, two shuttles with different yarns in each shuttle are employed, i.e., one very high modulus yarn and the other very low modulus yarn, but the shed is not changed until both shuttles have been thrown, the two yarns thus lying side-by-side in the same shed. While the weaving techniques are different, the same effects may be achieved where the fabric is woven flat, as will be readily understood by the worker in the art.

DESCRIPTION OF THE PREFERRED EMBODIMENTS

Figure 1:
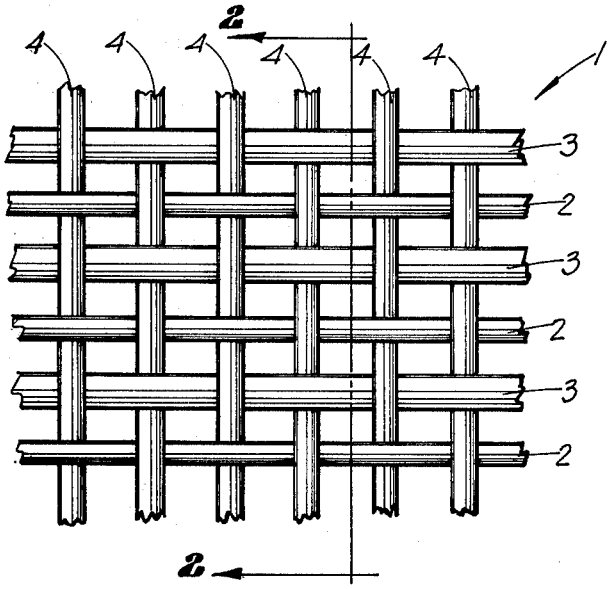
FIG. 1 is an enlarged fragmentary view of a section of a fabric woven in accordance with the present invention in which very high modulus yarns alternate with very low modulus yarns in the machine direction.
Figure 2:
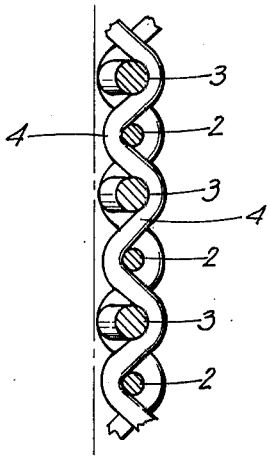
FIG. 2 is a longitudinal section of the fabric taken along the line 2—2 of FIG. 1.

Referring first to FIG. 1 of the drawings, the fabric 1, which is of plain weave construction, comprises very high modulus machine direction yarns 2 which alternate with very low modulus machine direction yarns 3, the machine direction yarns 2 and 3 being interwoven with cross-machine direction yarns 4. In an exemplary embodiment, the very high modulus machine direction yarns may comprise a 400 denier aramid resin yarn, such as DuPont's Kevlar [poly (p-phenylene terepthalamide)] having a modulus in excess of 2 gpd at 1% elongation. The very low modulus machine direction yarns may comprise a 0.23 mm polyester yarn having a modulus of from 0.2 to 0.8 gpd at 1% elongation. The cross-machine direction yarns 4 may be composed of any desired yarns, usually polyester yarns having a so-called standard modulus of from 0.9 to 1.2 gpd at 1% elongation, although yarns in the very low modulus range may be employed, and to this end the cross-machine direction yarns will be chosen consistent with the desired characteristic to be imparted to the fabric being produced.

While the embodiment illustrated in FIG. 1 illustrates a plain weave in which the very high and very low modulus yarns 2 and 3, respectively, are present in a 1:1 ratio, it will be understood that other weave patterns and other ratios of the very high and very low modulus machine direction yarns may be utilized without departing from the spirit and purpose of the invention, the primary factor being the interspersing of the very high modulus yarns and the very low modulus yarns, the very high modulus yarns providing the necessary strength and the very low modulus yarns being readily crimped during weaving to provide the desired crimp amplitude. Depending upon the desired strength characteristics and degree of bicrimp required, there may be two picks of very low modulus yarn between each pick of very high modulus yarn, or alternatively there may be two picks of very high modulus yarn between each pick of very low modulus yarn.

Figure 3:
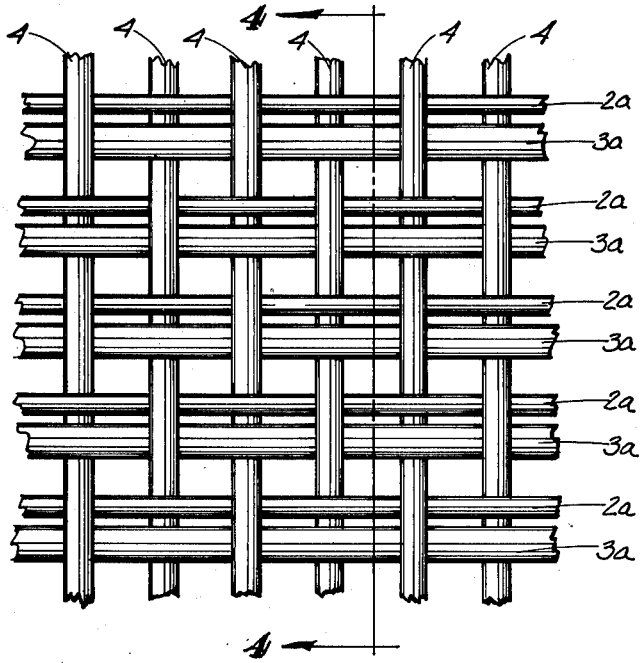
FIG. 3 is an enlarged fragmentary view of a section of fabric in accordance with the invention illustrating two picks in a shed construction in which a very high modulus yarn and a very low modulus yarn lie side-by-side in the machine direction.
Figure 4:
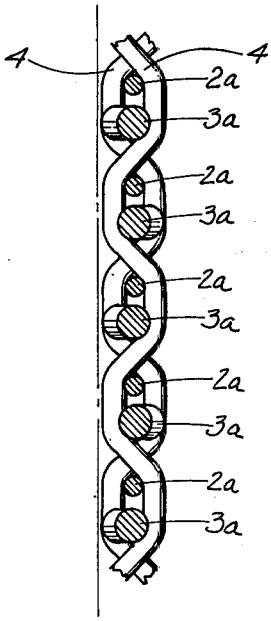
FIG. 4 is a longitudinal section of the fabric of FIG. 3 taken along the line 4—4.

FIGS. 3 and 4 illustrate a modification of the invention wherein a very high modulus yarn 2*a* and a very low modulus yarn 3*a* lie side-by-side in the machine direction to form two picks in a shed. In finishing the fabric, the very high modulus yarns 2*a* are pulled down into the fabric and help protect the crimp of the very low modulus yarns from distortion due to machine direction stress. This weaving technique has been found to be particularly suited for use in the manufacture of tissue transfer fabrics which require uniform knuckle patterns in the warp and filling yarns and stretch resistance under high temperature conditions over a long period of time.

Exemplary fabrics made in accordance with the present invention are as follows:

Example I

A forming fabric was produced consisting of:

1. Very high modulus aramid (Kevlar) 200 denier multifilament machine direction yarns having an initial modulus of about 5 gpd.
2. Very low modulus monofilament polyester machine direction yarns of 0.009 inch diameter and an initial modulus of about 0.45 gpd.
3. Monofilament polyester cross-machine direction yarns of 0.010 inch diameter having an initial modulus of 1.05 gpd at a density of 50 ends per inch.

The machine direction yarns were woven into the polyester cross-machine direction yarns using "two picks in a shed" weaving techniques and a four harness sateen weave pattern on a loom set up to weave endless fabric at a density of 94 picks per inch. The yarns took on a significant crimp during the weaving process. The woven fabric was then placed on a finishing machine using tenter pins to restrain cross-machine direction shrinkage. The fabric was exposed to increasing heat and tension and was finally heat set at 400° F. under a machine direction tension of 42 lbs. per linear inch. The applied tension was sufficient to pull out all of the crimp of the very high modulus machine direction yarns, but it had relatively little effect on the crimp of the very low modulus machine direction yarns. The ratio of crimp amplitudes of the very low modulus machine direction yarns and the cross-machine direction polyester yarns was 1.07. The resultant fabric was found to have superior sheet marking and superior stretch resistance characteristics.

Example II

A transfer fabric was produced consisting of:

1. Very high modulus aramid (Kevlar) 200 denier multifilament machine direction yarns having an initial modulus of about 5 gpd. Previous to weaving the yarn was coated with twelve coats of Nylon polymer using a conventional machine for coating plastic on wire.
2. Very low modulus monofilament polyester yarns of 0.018 inch diameter and an initial modulus of about 0.33 gpd.
3. Monofilament polyester cross-machine direction yarns of 0.018 inch diameter and an initial modulus of about 0.7 gpd at a density of 26 ends per inch.

The machine direction yarns were woven into the polyester cross-machine direction yarns at a density of 52 picks per inch using "two picks in a shed" techniques and a ½ twill weave pattern on a loom set to weave endless fabrics. The warp and filling yarns took on significant crimp during the weaving process. The woven fabric was then placed on a finishing machine and exposed to increasing heat and tension, the fabric being finally heat set at 400° F. under a machine direction tension of 47.5 lbs. per lineal inch. The tension applied was sufficient to pull out all of the crimp of the very high modulus machine direction yarns, but had relatively little effect on the crimp of the very low modulus machine direction yarns. The ratio of crimp amplitudes of the very low modulus machine direction yarns and the cross-machine direction yarns was 0.80.

The very high modulus aramid yarns provided superior heat degradation properties as compared to conventionally used load bearing polyester yarns. In this instance the cross-machine direction yarns are of larger diameter and have an initial modulus falling in the very low modulus range, which is preferred in a transfer fabric, the bicrimp configuration of the very low modulus machine direction yarns and cross-machine direction yarns permitting the embossing of a tissue paper with a desirable ½ twill pattern.

As should now be evident, the instant invention provides fabrics having high stretch resistance and improved fabric stability, together with excellent bicrimp configuration. The fabrics may be woven utilizing either flat or endless weaving techniques, the essential consideration being that the very high and very low modulus yarns extend in the machine direction of the fabric when in use. Various types of yarns may be utilized, inclusive of polyester and Nylon yarns, which may be plain or coated depending upon the characteristics to be imparted to the fabric. Similarly, where heat resistance is required, as in a tissue transfer fabric, the yarns will be chosen to provide the desired degree of heat resistance. The cross-machine direction yarns, on the other hand, will be chosen consistent with characteristics to be imparted to the fabric.

Modifications may be made within the invention without departing from its spirit and purpose. For example, while the invention has been described in conjunction with single ply fabrics, the principles of the invention are applicable to multiple layer fabrics, such as the dual loop forming fabric disclosed in Justus et al. U.S. Pat. No. 3,127,308 entitled "Dual Wire Dewatering Apparatus". Consequently, it is not intended that the invention be limited other than in the manner set forth in the claims which follow.

The embodiment of the invention in which an exclusive property or privilege is claimed are defined as follows:

1. A papermaking fabric having interwoven machine direction and cross-machine direction yarns, said machine direction yarns being formed from interspersed very high modulus yarns having an initial (1%) modulus greater than 2.0 gpd and very low modulus yarns having an initial (1%) modulus of from 0.2 to 0.8 gpd, said very high modulus machine direction yarns characterized by exhibiting low elongation under load, and said very low modulus machine direction yarns characterized by being deformable and exhibiting high elongation under load.

2. The papermaking fabric claimed in claim 1 wherein said very high and very low modulus machine direction yarns lie in a pick and pick relationship.

3. The papermaking fabric claimed in claim 1 wherein said very high and very low modulus machine direction yarns lie in a two pick in a shed relationship.

4. The papermaking fabric claimed in claim 1 wherein said very high modulus machine direction yarns are buried beneath the surfaces of the fabric.

5. The papermaking fabric claimed in claim 4 wherein said fabric comprises a forming fabric, and wherein said cross-machine direction yarns have an initial (1%) modulus of from 0.9 to 1.2 gpd.

6. The papermaking fabric claimed in claim 4 wherein said fabric comprises a transfer fabric characterized by very high modulus machine direction yarns having high heat resistance, and by cross-machine direction yarns having an initial (1%) modulus below 0.9 gpd.

7. The papermaking fabric claimed in claim 6 wherein said very high modulus machine direction yarns comprise an aramid resin.

* * * * *